US010537167B2

(12) United States Patent
Bryant et al.

(10) Patent No.: US 10,537,167 B2
(45) Date of Patent: Jan. 21, 2020

(54) SELF-ADJUSTING VARIABLE SIZE HOLSTER

(71) Applicant: Pitbull Tactical, LLC, Orlando, FL (US)

(72) Inventors: Richard Bryant, Orlando, FL (US); Jeffrey Brodsky, Hauser, ID (US)

(73) Assignee: Pitbull Tactical, LLC, Orlando, FL (US)

( * ) Notice: Subject to any disclaimer, the term of this patent is extended or adjusted under 35 U.S.C. 154(b) by 0 days.

(21) Appl. No.: 16/031,061

(22) Filed: Jul. 10, 2018

(65) Prior Publication Data

US 2019/0014892 A1 Jan. 17, 2019

Related U.S. Application Data

(60) Provisional application No. 62/532,436, filed on Jul. 14, 2017.

(51) Int. Cl.

| | |
|---|---|
| ***A45F 5/00*** | (2006.01) |
| ***A45F 5/02*** | (2006.01) |
| ***F42B 39/02*** | (2006.01) |

(52) U.S. Cl.

CPC ..... *A45F 5/021* (2013.01); *F42B 39/02* (2013.01); *A45F 2200/0508* (2013.01); *A45F 2200/0516* (2013.01); *A45F 2200/0591* (2013.01)

(58) Field of Classification Search

CPC ... A45F 5/021; A45F 2200/0591; F42B 39/02
USPC ..... 224/678
See application file for complete search history.

(56) References Cited

U.S. PATENT DOCUMENTS

| | | | | |
|---|---|---|---|---|
| 1,756,677 | A | 4/1930 | Cook | |
| 3,668,802 | A * | 6/1972 | Benward | A01K 97/06 224/245 |
| 5,174,482 | A | 12/1992 | Rogers et al. | |
| 6,154,997 | A | 12/2000 | Aluotto et al. | |
| 6,202,908 | B1 * | 3/2001 | Groover | F42B 39/02 224/236 |
| 7,025,238 | B2 * | 4/2006 | Hughes | A45F 5/00 206/3 |
| 7,614,534 | B2 | 11/2009 | Veo et al. | |
| 7,780,048 | B2 | 8/2010 | Howell | |
| D642,793 | S | 8/2011 | Rogers et al. | |
| 8,231,038 | B2 | 7/2012 | Felts | |
| 8,308,033 | B2 | 11/2012 | Case et al. | |

(Continued)

*Primary Examiner* — Peter N Helvey
(74) *Attorney, Agent, or Firm* — Wood Herron & Evans LLP

(57) ABSTRACT

A self-adjusting holster includes first and second shell portions having opposite side panels extending substantially parallel to each other. At least one of the first and second shell portions having a bottom panel. The side panels of the first shell portion and side panels of the second shell portion are configured to telescopically mate such that the mated shell portions slidably adjust relative to each other in a first direction and together define an interior space and an open end opposite the bottom panel. An elastomeric member is configured to bias the shell portions toward each other along the first direction. An item inserted into the open end between the first and second shell portions displaces the shell portions relative to each other against biasing force provided by the elastomeric member.

11 Claims, 4 Drawing Sheets

(56) References Cited

U.S. PATENT DOCUMENTS

| | | | | |
|---|---|---|---|---|
| 8,733,606 | B2 * | 5/2014 | Felts | F42B 39/02 224/245 |
| 9,097,489 | B2 * | 8/2015 | Chiang | F42B 39/02 |
| 9,394,080 | B2 | 7/2016 | Beck | |
| D772,368 | S * | 11/2016 | Evans | D22/108 |
| 9,795,210 | B2 | 10/2017 | Evans | |
| 9,861,184 | B2 * | 1/2018 | VanHeusen | A45F 5/02 |
| 2011/0107645 | A1 * | 5/2011 | Faifer | F41A 9/63 42/90 |
| 2014/0103083 | A1 | 4/2014 | Sitz | |
| 2014/0262842 | A1 * | 9/2014 | Beck | B65D 21/08 206/3 |
| 2016/0003598 | A1 * | 1/2016 | Gadams | F42B 39/02 206/3 |
| 2016/0066680 | A1 | 3/2016 | Hazeltine | |
| 2017/0099934 | A1 * | 4/2017 | Evans | F42B 39/02 |

* cited by examiner

SELF-ADJUSTING VARIABLE SIZE HOLSTER

RELATED APPLICATIONS

This application claims priority to U.S. Provisional Patent Application No. 62/532,436, filed Jul. 14, 2017, and incorporates the same herein by reference.

TECHNICAL FIELD

This invention relates to a holster for holding small items, such as detachable ammunition magazines or other small items. In particular, it relates to such a holster that will self-adjust to securely hold items that may vary in size, within a selected range, and that may be attachable to a support, such as a belt.

BACKGROUND

Various items are often carried on a user's belt for ready access. These items can include ammunition magazines, flashlights, mobile phones, or other electronic devices. Each of these items comes in varying sizes, although each is likely to fall within certain range of variance. Typically, to hold such items securely, a holster or carrier must be sized to the particular dimensions of the item. Specialized holsters designed to hold one specific item or size are costly to manufacture because many different models must be designed, made, and maintained in inventory.

Existing carriers that will accommodate items of varied size typically are in the form of a pouch made of fabric or other flexible material that is either stretchable or includes elastic panels. Such soft pouches give the item little protection against damage caused by impact against another hard item or surface. Other adjustable holsters either vary in only one dimension or are not self-adjusting, requiring pre-adjustment to a specific size.

SUMMARY OF THE INVENTION

The present invention provides a "universal" holster or carrier that will accommodate items of various width and depth between telescoping shell units. Variance in depth can be accommodated by telescopic adjustment of the shell parts, secured together by an elastomeric retainer. Variance in width may be accommodated by internal spring-biased tabs. Both variances are accommodated automatically upon insertion of the item into the holster.

In one embodiment, the self-adjusting holster may include first and second shell portions having opposite side panels extending substantially parallel to each other. At least one of the first and second shell portions may have a bottom panel. The side panels of the first shell portion and side panels of the second shell portion can be configured to telescopically mate such that the mated shell portions slidably adjust relative to each other in a first direction and together define an interior space and an open end opposite the bottom panel. An elastomeric member may be configured to bias the shell portions toward each other along the first direction. An item inserted into the open end between the first and second shell portions displaces the shell portions relative to each other against biasing force provided by the elastomeric member.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
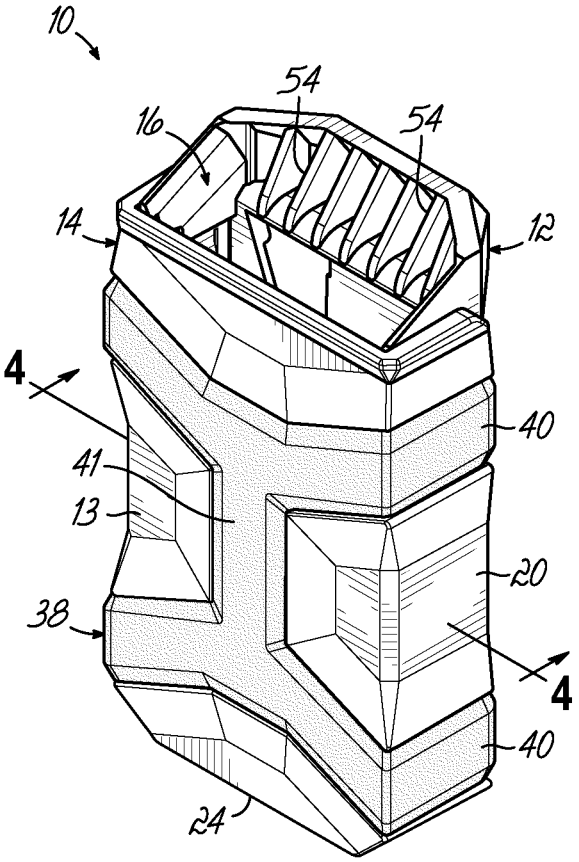
FIG. 1 is a front isometric view of a self-adjusting variable holster according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
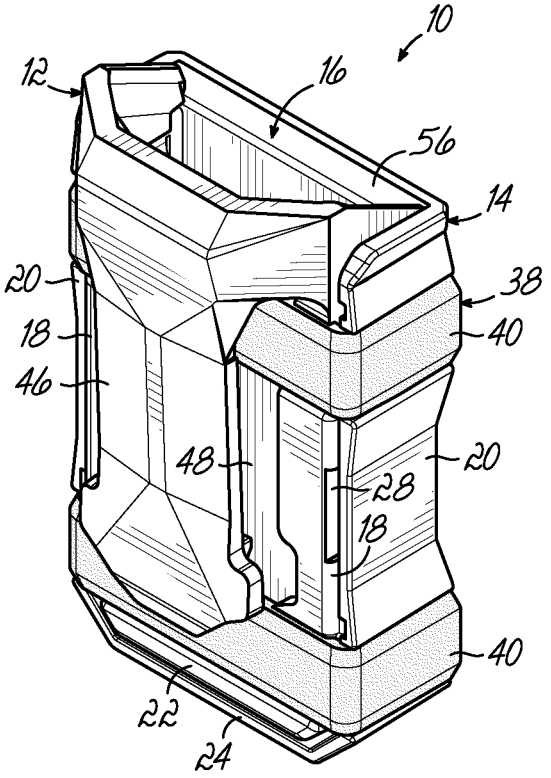
FIG. 2 is a rear isometric view thereof.
Figure 3:
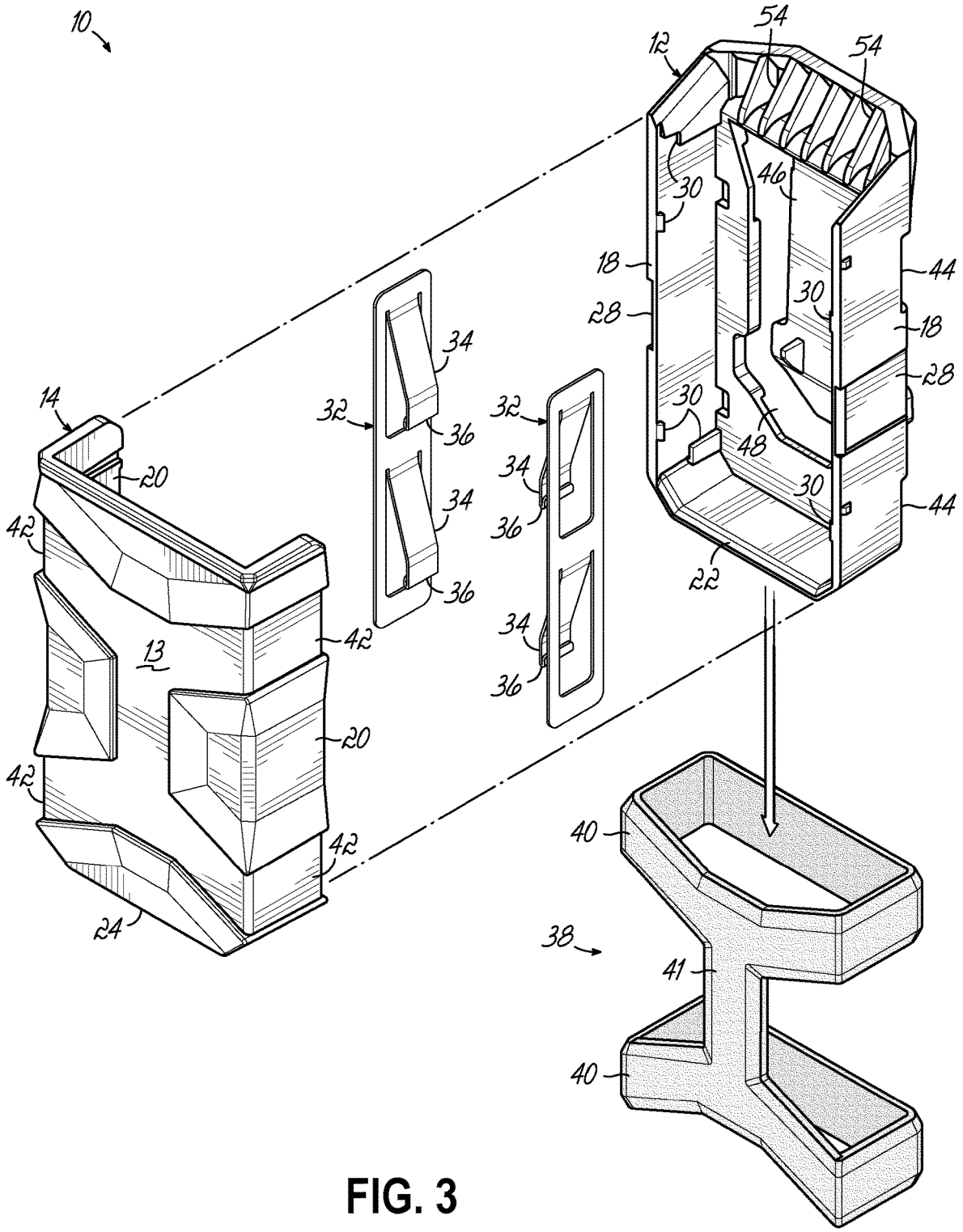
FIG. 3 is an exploded isometric view thereof.
Figure 4:
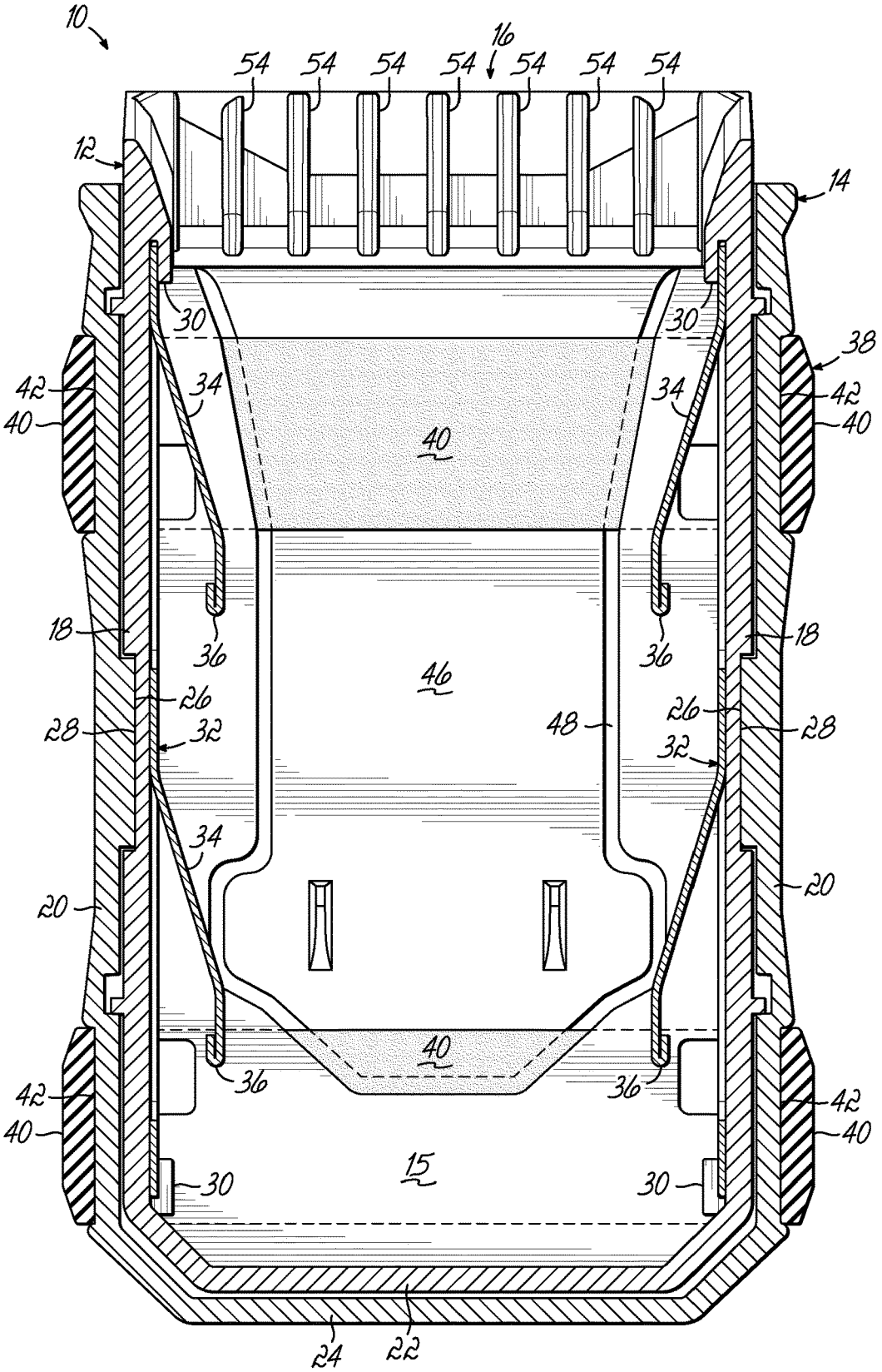
FIG. 4 is a sectional view taken sustainably along line 4-4 of FIG. 1.

Referring first to FIGS. 1-3, therein is shown a self-adjusting variable size holster 10 according to one embodiment of the present invention. The holster 10 may include a rear shell portion 12 and a front shell portion 14 that can be fitted together in a telescoping manner to provide a support enclosure having a substantially open top end 16. The front and rear shell portions 12, 14 may include face panels 13, 15 from which elongated sidewalls 18, 20 and bottom walls 22, 24 extend substantially orthogonal to the face panel 13, 15. The telescoping engagement can be additionally guided by a tongue feature 26 formed on an inner surface of, for example, the front sidewalls 20 that slides within a groove feature 28 formed in outer surfaces of the rear sidewalls 18. The sidewalls 18, 20 can be separate from or contiguous with the respective bottom walls 22, 24.

Inside surfaces of the rear shell 12 or sidewalls 18 can include engagement features 30 that secure spring tab panels 32 in place. The spring tab panels 32 can include integral spring arms 34 with rolled edges 36 at their free ends. The arms 34 resiliently deflect in response to a force against them and return to an at-rest position when the force is removed.

The front and rear shell portions 12, 14 may be adjustably held together by at least one elastomeric tension band 38. The tension band 38 may include one or more stretchable tension loop portions 40 that sustainably encircle the assembled the upper and lower shell portions 12, 14. In the illustrated embodiment, the band 38 has two loop portions 40 that are longitudinally spaced apart and may be integrated as a single piece by an interconnector portion 41. The tension band 38 may be made of any suitable and durable elastomeric material, such as rubber, silicone, or a resilient synthetic. To more securely maintain proper position of the tension band 38 and loop portions 40, outer surfaces of the front and rear shell portions 12, 14 may include guideways 42, 44 that provide a groove to retain the loop portions 40 or interconnector portion 41 of the tension band 38.

If desired, the rear portion 12 may include an attachment device, such as a belt clip 46 or belt loop (not shown). In the illustrated embodiment, the belt clip 46 is formed integrally with the rear shell portion and aligned with a rear opening 48 that allows for efficient and easier injection molding of this part. Alternatively, a belt clip 46 or loop may be a separate member secured to the rear shell portion 12 or other part of the holster 10. The illustrated embodiment can be worn on a belt, outside the waistband, using the clip 46, or it may be worn inside the waistband by reversing the direction of the holster 10 so that the clip 46 is attached over the top edge of pants and/or belt.

When assembled, the spring arms 34 can flex to accommodate items of varying width held by the holster 10. Likewise, the telescopic engagement of the rear and front shell portions 12, 14 can move apart or together to accommodate items of varying depth. The spring arms 34 of the spring tab panels 32 allow the width to be self-adjusting, within a predetermined range. Likewise, the elastic nature of the tension band 38 allows relative movement between the rear and front shell portions 12, 14 in a self-adjusting manner to accommodate items of varied depth.

Figure 5:
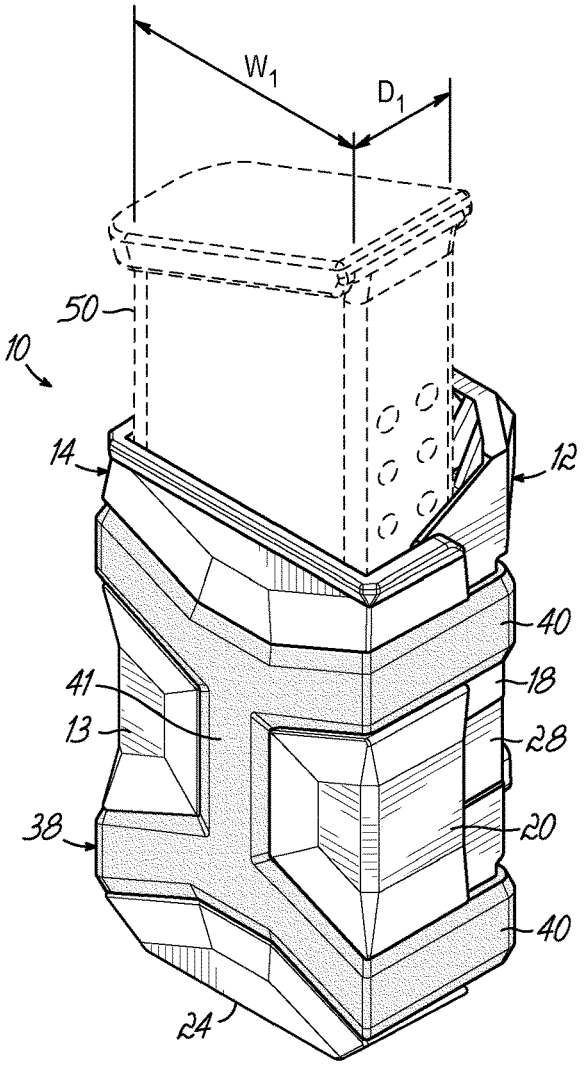
FIG. 5 is a perspective view showing the holster holding an ammunition magazine of a first size.
Figure 6:
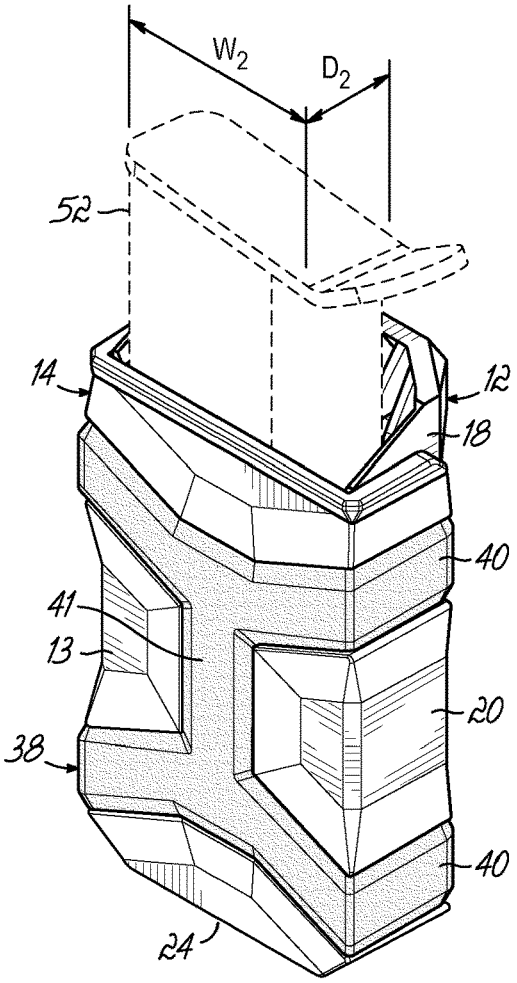
FIG. 6 is a similar perspective view showing the holster holding an ammunition magazine of a second size.

Referring now in particular to FIGS. 5 and 6, FIG. 5 shows the holster 10 holding a first ammunition magazine 50 (for example) having a width Wt that flexes the spring arms 32 outward and away from their at-rest position. Likewise, the magazine 50 has a depth $D_1$ that stretches at least the loop portions 40 of the elastomeric tension band 38, allowing only the required amount of displacement of the front shell portion 14 relative to the rear shell portion 12. Ramp surfaces 54, 56 adjacent to open end 16 of the front and rear shell portions 12, 14 can guide the item being inserted and act as a cam to move the shell portions 12, 14 apart. Likewise, the downwardly sloping angle of the spring arms 34 can accommodate the insertion and self-centering function. As shown in FIG. 6, the same holster 10 can securely hold an ammunition magazine 52 of a second, smaller size. The smaller width W2 is accommodated between the spring arms 34 in an unflexed or less flexed state. Likewise, the depth $D_2$ of the magazine 52 may allow the shell portions 12, 14 to be in an un-extended or less extended relationship. The sizing and position relationship of the various members occurs automatically upon insertion of a larger or smaller item, such as the illustrated ammunition magazines 50, 52 without any additional action or pre-adjustment by the user.

Holsters according to the present invention can be made in other sizes to accommodate smaller or larger items or size ranges of items. Likewise, the shape of the shell portions 12, 14 and/or spring arms 34 can be changed to accommodate other shapes, such as round, flat, or a combination thereof. The holster 10 can be adapted in size and shape to accommodate items other than ammunition magazine that vary in size and shape within certain limits, such as flashlights, pepper spray devices, mobile phones, knives, tools, handcuffs, radios, etc.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the claim or claims

What is claimed is:

1. A self-adjusting holster, comprising:

a first shell portion having opposite side panels extending substantially parallel to each other;

a second shell portion having opposite side panels extending substantially parallel to each other;

at least one of the first and second shell portions having a bottom panel;

the side panels of the first shell portion and side panels of the second shell portion being configured to telescopically mate such that the mated shell portions slidably adjust relative to each other in a first direction and together define an interior space and an open end opposite the bottom panel; and an elastomeric member comprising a unitary band that externally encircles the mated shell portions configured to bias the shell portions toward each other along the first direction, wherein, an item inserted into the open end between the first and second shell portions displaces the shell portions relative to each other against biasing force provided by the elastomeric member to self-adjust the size of the interior space in the first direction.

2. The self-adjusting holster of claim 1, further comprising at least one resiliently deflectable guide member on a shell portion configured to self-adjust the position of an item inserted between the shell portions in a second direction.

3. The self-adjusting holster of claim 2, wherein the guide member includes a deflectable spring arm.

4. The self-adjusting holster of claim 2, further comprising a second resilient guide member.

5. The self-adjusting holster of claim 1, wherein the open end includes a flared mouth region defined by at least one of the shell portions.

6. The self-adjusting holster of claim 1, wherein both shell portions include a bottom panel.

7. The self-adjusting holster of claim 1, further comprising an attachment device on one of the shell portions.

8. The self-adjusting holster of claim 7, wherein the attachment device includes a clip.

9. The self-adjusting holster of claim 1, wherein at least one shell portion includes a substantially flat face panel between the side panels.

10. The self-adjusting holster of claim 1, wherein the elastomeric member comprises two unitary bands that externally encircle the mated shell portions at spaced-apart positions and wherein the bands are integrally interconnected to each other.

11. The self-adjusting holster of claim 1, comprising at least one exterior guideway on at least one of the shell portions to position the elastomeric member.

* * * * *